US005881777A

United States Patent [19]

Bassi et al.

[11] Patent Number: 5,881,777

[45] Date of Patent: Mar. 16, 1999

[54] WEAVING LOOM WITH THREE-POSITION JACQUARD SELECTION DEVICE

[75] Inventors: Dario Bassi, Chaponnay; Damien Bouchet, Decines, both of France

[73] Assignee: Staubli Lyon, Chassieu Cedex, France

[21] Appl. No.: 980,764

[22] Filed: Dec. 1, 1997

[30] Foreign Application Priority Data

Nov. 29, 1996 [FR] France ..... 96 14965

[51] Int. Cl.[6] ..... D03C 3/20

[52] U.S. Cl. ..... 139/455; 335/219

[58] Field of Search ..... 139/455, 65; 335/219, 335/234

[56] References Cited

U.S. PATENT DOCUMENTS 5,309,953 5/1994 Bassi et al. ..... 139/455
5,333,652 8/1994 Bassi et al. ..... 139/455
5,392,820 2/1995 Seiler ..... 139/455
5,671,784 9/1997 Dewispelaere ..... 139/455

FOREIGN PATENT DOCUMENTS 0723041 7/1996 European Pat. Off. .

*Primary Examiner*—Andy Falik
*Attorney, Agent, or Firm*—Dowell & Dowell, P.C.

[57] ABSTRACT

A three position weave system selection device for a weaving loom which includes two superposed electromagnets adapted to be selectively activated to control the position of at least one lever articulated relative to the electromagnets. The at least one lever is provided with two magnetic armatures adapted to cooperate selectively with the two electromagnets so as to generate three positions of the at least one lever relative to two mobile hooks of a harness system of the weaving loom.

10 Claims, 3 Drawing Sheets

WEAVING LOOM WITH THREE-POSITION JACQUARD SELECTION DEVICE

BACKGROUND OF THE INVENTION

1. Field of the Invention

The present invention relates to a selection device, to a three-position Jacquard weaving loom weave system, and to a weaving loom equipped with such a weave system.

2. History of the Related Art

A weaving loom incorporating a weave system adapted to generate three positions of the warp yarns, is used for making special fabrics, such as velvet or a carpet.

European Patent Application No. 0 723 041 discloses a three-position Jacquard system in which the mobile hooks associated with a funicular element determining the height of a heddle, may be selected thanks to two superposed electro-magnets. This device is complex and induces repeated deformations of the mobile hooks, which prevents giving them an adequate rigidity to guarantee a sufficient life duration for industrial application and high-speed operation. In addition, the considerable deformations imposed on these hooks require powerful electro-magnets, with the result that the energy used by the loom with which the known weave system is associated and which presents a large number of electro-magnets, is considerable.

It is an object of the present invention to overcome these problems by proposing a three-position weave system selection device which is simple, therefore economical, adapted to operate at high speeds and consuming little energy. According to another aspect of the invention, it aims at providing a selection device capable of operating with hooks adapted to be displaced in pairs, a first hook of each pair being in simple abutment on the second hook of this same pair.

SUMMARY OF THE INVENTION

To that end, the invention relates to a three-position weave system selection device comprising two superposed electro-magnets adapted to be selectively activated, characterized in that it comprises at least one lever articulated about a shaft secured to the device, the lever being provided with magnetic armatures adapted to cooperate selectively with the electro-magnets so as to generate three positions of the lever.

Thanks to the invention, the lever may be placed, as desired, in one of these three positions which correspond to the three desired heights of the warp yarns of the weaving loom during operation. The lever is pivoted without deformation of the elements which constitute it or of the mobile hooks which it makes possible to select, this avoiding mechanical fatigue of these elements.

According to a first advantageous aspect of the invention, the lever comprises an amagnetic structure in which are housed the magnetic armatures. This aspect of the invention makes it possible to decouple the operation of the magnetic armatures and of the electro-magnets associated therewith. In that case and in accordance with another advantageous aspect of the invention, at least one of the armatures is mobile with respect to the amagnetic structure. This aspect of the invention makes it possible to give the articulated lever an additional degree of freedom when one of the armatures has a position fixed by its cooperation with the electro-magnet with which it is associated.

In accordance with another advantageous aspect of the invention, an armature mobile with respect to the amagnetic structure and this amagnetic structure are articulated independently of one another about the shaft. This construction therefore allows an angular clearance of a magnetic armature with respect to the amagnetic structure.

According to another advantageous aspect of the invention, the mobile armature is provided with a heel element adapted to transmit to the amagnetic structure a pivoting torque about this shaft.

According to another advantageous aspect of the invention, the amagnetic structure is provided with a bar adapted to transmit to the mobile armature a pivoting torque about the shaft.

According to another advantageous aspect of the invention, the lever comprises an end adapted to penetrate selectively in a substantially horizontal orifice of one or two mobile hooks supporting a funicular element determining the position of at least one heddle of the weave system. The end of the lever thus constitutes a means for immobilization of the hooks of the weave system in the vicinity of the top dead center of their path.

According to another advantageous aspect of the invention, the end of the lever is adapted to be displaced by one of the hooks when it arrives near the top dead center of its path. This aspect of the invention makes it possible to obtain levelling of the position of the levers of the weave system comprising a device according to the invention, which makes it possible to limit the power of the electro-magnets which do not have to displace the levers, but serve solely to maintain them selectively in position.

The invention also relates to a three-position Jacquard loom weave system comprising a selection device as described hereinabove, and to a weaving loom equipped with such a weave system.

BRIEF DESCRIPTION OF THE DRAWINGS

The invention will be more readily understood on reading the following description with reference to the accompanying drawings, in which.

DESCRIPTION OF PREFERRED EMBODIMENTS

Figure 1:
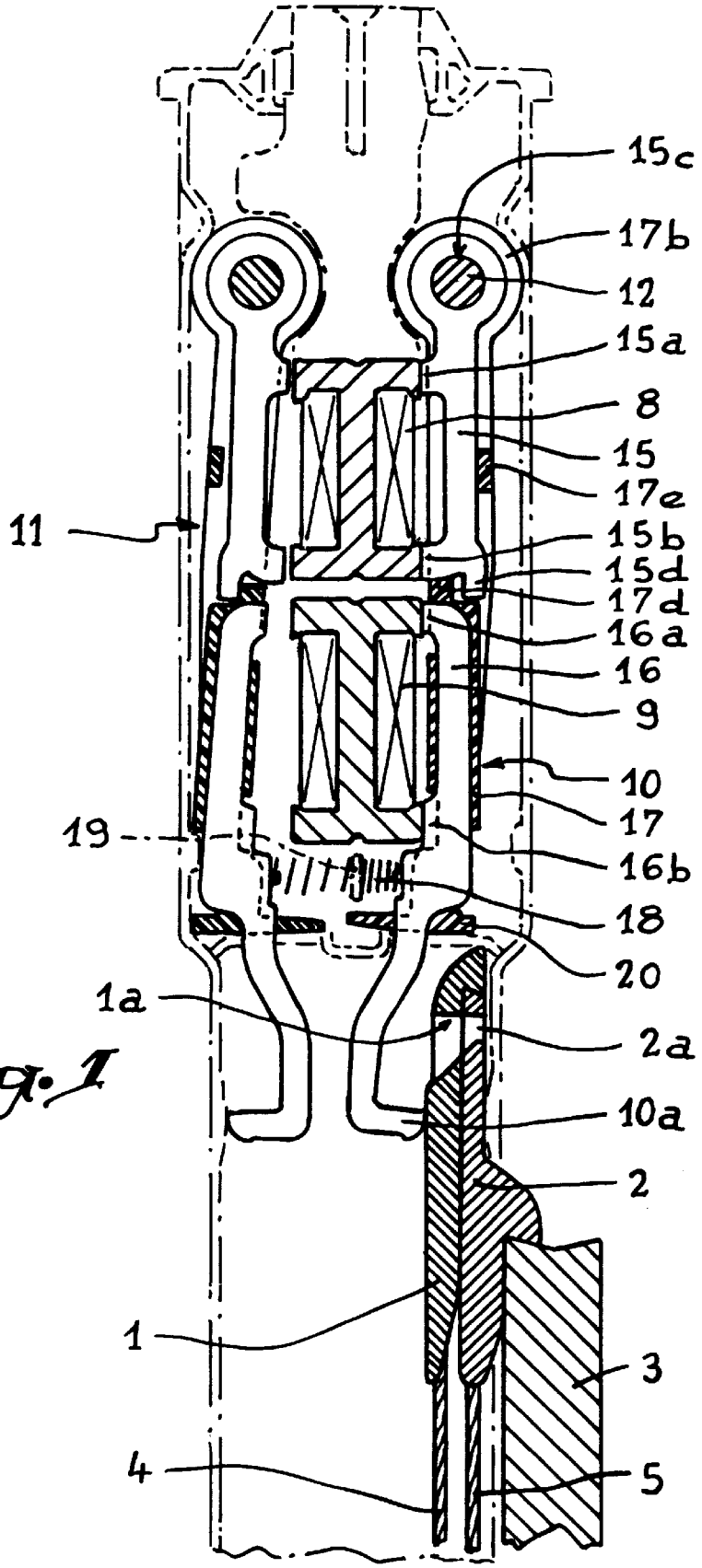
FIG. 1 is a view in longitudinal section of a weave system selection device according to the invention in a first position.

Referring now to the drawings, the three-position weave system selection device shown in FIG. 1 is intended to immobilize, in the vicinity of the top dead center of their path, two mobile hooks 1 and 2 adapted to be displaced in abutment on a knife 3 animated by vertical reciprocating movements. These mobile hooks 1 and 2 are respectively connected to a cord 4 or 5 constituting a funicular element for vertically displacing a pulley controlling the height of a heddle belonging to a Jacquard harness. These hooks function in pairs, one abutting on the other in the manner described in Applicants' French Patent Application FR-96 12329. The system comprises two superposed electro-magnets 8 and 9 adapted to be selectively activated by means of a control module (not shown).

On either side of the electro-magnets 8 and 9 there are disposed two levers 10 and 11, of which lever 10 will be described in greater detail hereinafter, lever 11 being identical. Lever 10 is pivotally articulated about a shaft 12 secured to the frame of the device. Lever 10 is provided with a first magnetic armature 15, likwise mounted pivotally about shaft 12, and with a second magnetic armature 16 captive of an amagnetic structure 17 whose geometry is more clearly visible in FIG. 4. Parts 15 to 17 form the lever 10 which is an actuator of the selection device. The armatures 15 and 16 are respectively provided with extensions 15*a*, 15*b*, 16*a* and 16*b* adapted to come into abutment against the upper and lower poles of the electro-magnets 8 and 9. As is more clearly apparent on comparing FIGS. 1, 2 and 3, the lever 10 is adapted to take three positions against the force of a spring 18 in abutment on a central rib 19 secured to the frame of the device.

When the two electro-magnets 8 and 9 are activated, the magnetic armatures 15 and 16 are maintained applied against the poles of the electro-magnets, with the result that the lower end 10*a* of the lever 10 is maintained withdrawn with respect to the hooks 1 and 2. In that case, the end 10*a* does not penetrate in a substantially horizontal orifice 1*a* of the hook 1, with the result that, when the knife 3 starts its movement of descent, the hooks 1 and 2 descend in abutment on this knife 3.

The position of FIG. 1 is attained whatever the state of activation or of non-activation of the electro-magnet 8, as the force obtained by the cooperation of the electro-magnet 9 and of the second armature 16 is sufficient to overcome the return effort due to the spring 18.

Figure 2:
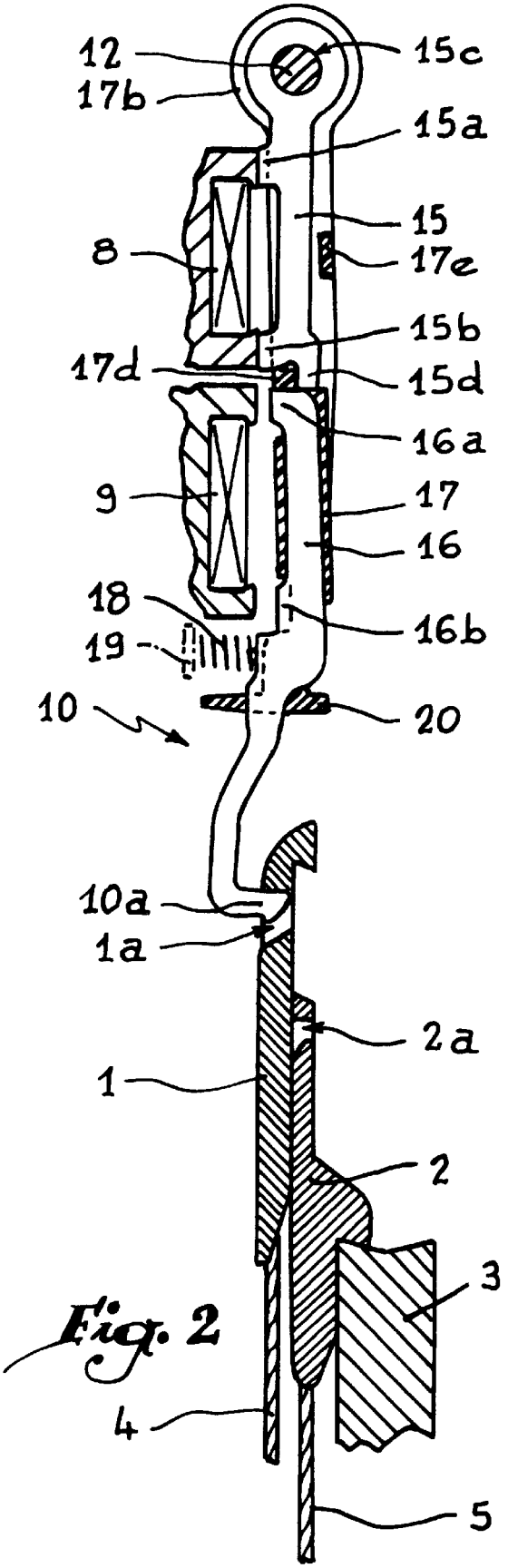
FIG. 2 is a partial view of the right-hand part of the device of FIG. 1 in a second position.

In the position of FIG. 2, only the electro-magnet 8 is activated, with the result that, under the effect of the return force of the spring 18, the end 10*a* of the lever 10 penetrates in the orifice 1*a* of the hook 1 and maintains the cord 4 and the pulley which is associated therewith (not shown), in upper position, while the hook 2 follows the knife 3 in its descending movement.

Figure 3:
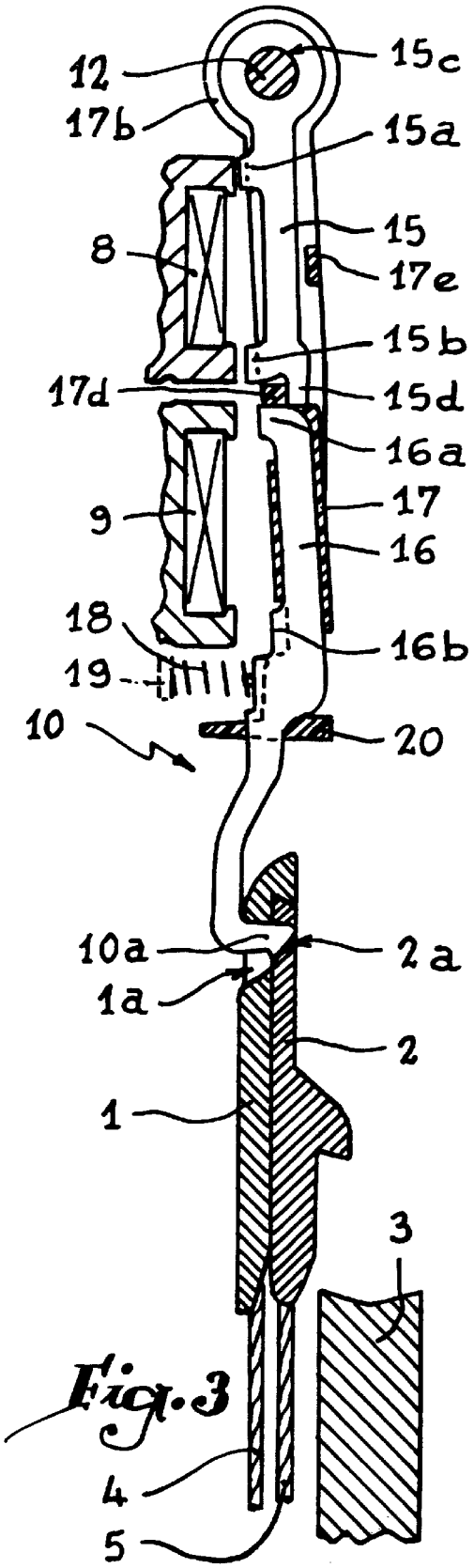
FIG. 3 is a view similar to FIG. 2 while the device is in a third position.
Figure 4:
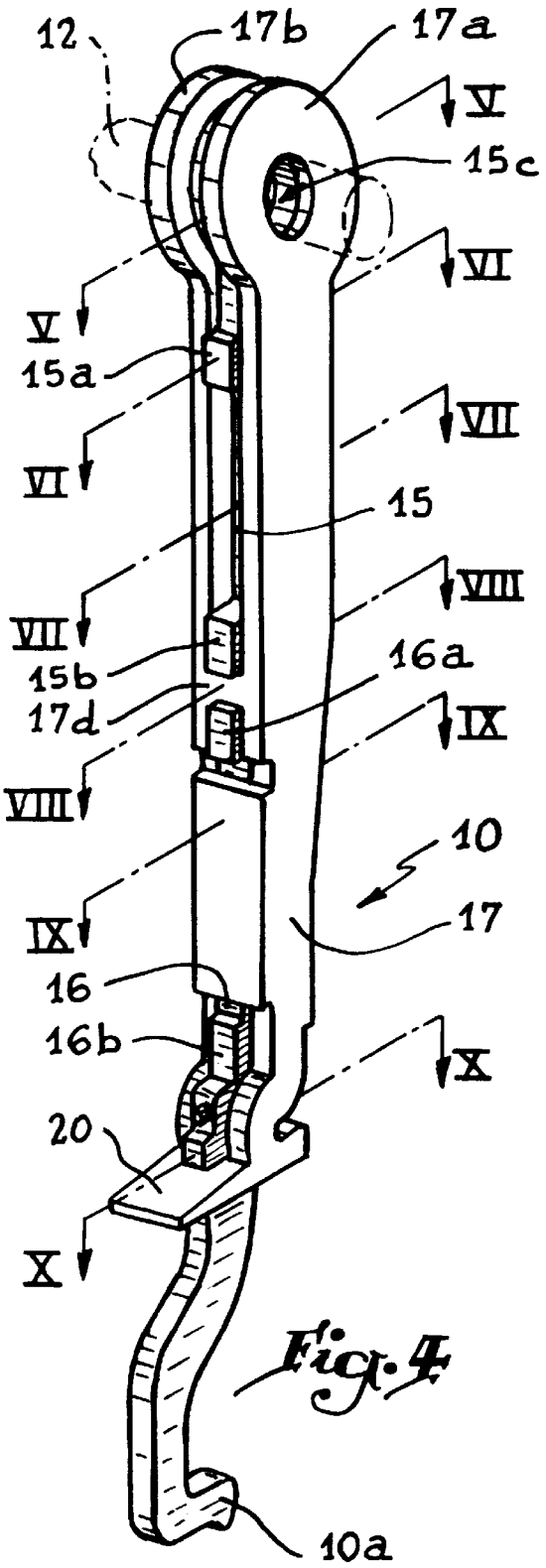
FIG. 4 is a view in perspective of a lever belonging to the device of FIG. 1.
Figure 5:
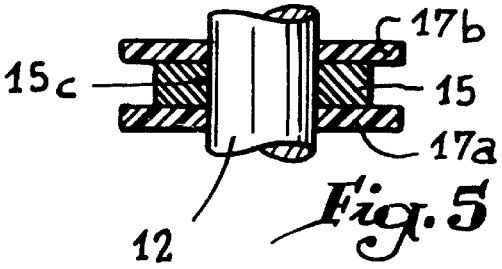
FIG. 5 is a section along line V—V of FIG. 4.
Figure 6:
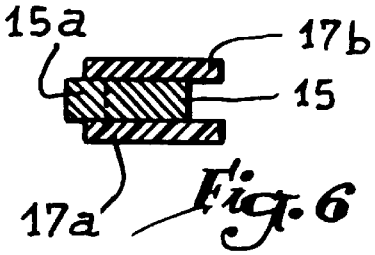
FIG. 6 is a section along line VI—VI of FIG. 4.
Figure 7:
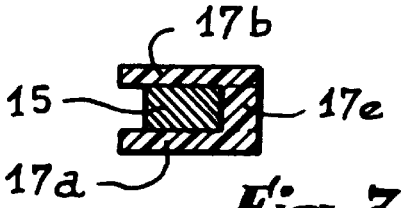
FIG. 7 is a section along line VII—VII of FIG. 4.
Figure 8:
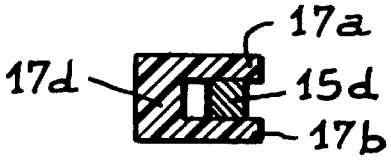
FIG. 8 is a section along line VIII—VIII of FIG. 4.
Figure 9:
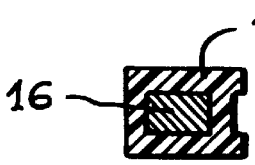
FIG. 9 is a section along line IX—IX of FIG. 4.
Figure 10:
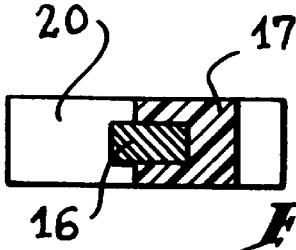
FIG. 10 is a section along line X—X of FIG. 4.

In the position of FIG. 3, when neither of the electro-magnets 8 or 9 is activated, the return force due to the spring 18 pushes the end 10*a* of the lever 10 towards the hooks 1 and 2, with the result that it both penetrates in the horizontal orifices 1*a* and 2*a* and it immobilizes the hooks 1 and 2 in the vicinity of the top dead center of their path.

Thus, as a function of the cooperation of the armatures 15 and 16 with the electro-magnets 8 and 9, the lever 10 is in one of the three positions respectively shown in FIGS. 1, 2 and 3.

In accordance with a particularly advantageous aspect of the invention, the armature 15 is mobile with respect to the amagnetic structure 17. To that end, it terminates in an eyelet 15*c* making it possible to articulate it, independently of armature 17, about the shaft 12. As for the armature 17, it comprises cheek elements 17*a* and 17*b*, pierced with a central hole and adapted to surround the eyelet 15*c* on the shaft 12. Thanks to this aspect of the invention, the armature 15 and the armature 16, which is captive of the structure 17, may be positioned independently of one another, with the result that their respective extensions 15*a*, 15*b*, 16*a* and 16*b* effectively bear, or not, against the poles of the electro-magnets 8 and 9.

The armature 15 is provided with a heel element 15*d* in its free end or part most remote from shaft 12. On the other hand, a crosspiece 17*d* of the structure 17 is disposed in the vicinity of the heel element 15*d*, with the result that, in the position of FIG. 2, the heel element 15*d* is adapted to exert on the crosspiece 17*d* a pivoting torque about shaft 12 tending to bring the lever 10 closer to the electro-magnets 8 and 9. This is effective in the position of FIG. 2 where the cooperation of the armature 15 and of the electro-magnet 8 makes it possible to limit the movement of the structure 17 and of the end 10*a* under the effect of the force of the spring 18.

Furthermore, the amagnetic structure 17 comprises, on its outer part, a bar 17*e*, disposed adjacent the armature 15, adapted to push the armature 15 towards the electro-magnet 8 as a function of the position of the structure 17. Thanks to this aspect of the invention, it is not necessary that the electro-magnet 8 be activated for the armature 15 to be applied against the poles of the electro-magnet 8. In fact, the displacement of the armature 16 against the force of the spring 18 induces the displacement of the structure 17 which is secured therewith and, thanks to the bar 17*e*, a pivoting torque about shaft 12 is transmitted to the armature 15, this torque having for effect to apply the armature 15 on the electro-magnet 8.

Thanks to the geometry of the end 10*a* of the lever 10, levelling of the position of the levers is obtained when the hooks 1 and 2 are in the vicinity of the top dead center of their path. In that case, in fact, the end 10*a* of the lever 10 is pushed towards the inside of the device thanks to the outer shape of the lever 21, which amounts to applying the armature 16 against the electro-magnet 9 and, thanks to the bar 17*e*, the armature 15 against the electro-magnet 8. The electro-magnets 8 and 9 thus work solely against the force due to the spring 18 to immobilize the armatures in applied position, but must not exert a considerable magnetic force to attract the armatures 15 or 16. The electro-magnets 8 and 9 may be dimensioned as a function of this sole function of immobilization and consume little current. An effective levelling of the two series of armatures of the levers 10 and 11 belonging to the selection device is thus obtained.

The lever 10 comprises a transverse plate 20 formed by a part of the amagnetic structure 17. The function of this plate 20 is to isolate the electro-magnets, the springs and the magnetic armatures from the ambient atmosphere in order to avoid stock or dust disturbing the operation of the device.

The armature 16 has been shown integral with the end 10*a* of the lever 10, but it is obvious that it might be interrupted below the lower part of the electro-magnet 9, i.e. approximately at the level of the spring 18, and the lower part of the lever 10*a* might be constituted by an extension of the amagnetic structure 17, and this without departing from the scope of the invention.

The invention has been described in connection with two hooks according to the invention of Applicants' French Patent Application FR-96 12329, but it is applicable to all types of hooks insofar as they may be selected as a function of the positions of the end of a lever.

A three-position Jacquard loom weave system according to the invention comprises a multiplicity of selection devices as described hereinabove and may operate with great reliability at high speeds, consuming little energy.

A weaving loom equipped with such a system thus makes it possible to obtain, at lower cost, special fabrics such as velvet or carpets.

What is claimed is:

1. In a selection device for a weaving system of a Jacquard loom which weaving system includes at least two hooks which are selectively moveable with a reciprocating knife with each hook being connected to a funicular element which displaces a pulley for controlling the position of a heddle frame of a harness, the improvement comprising; the selection device having two superposed electromagnets each adapted to be selectively activated, at least one lever having one end articulated about a shaft and a free end adapted to selectively engage the at least two hooks, said at least one lever including a first magnetic armature for selectively cooperating with a first of said electromagnets and a second magnetic armature for cooperating with a second of said electro magnets whereby the selective activation of said two electromagnets generates three different positions of said at least one lever relative to the at least two hooks by relative displacement of the first and second magnetic armatures relative to said first and second electromagnets.

2. The selection device for a weaving system of claim 1 wherein said at least one lever includes an amagnetic structure in which said first and second magnetic armatures are housed.

3. The selection device for a weaving system of claim 2 wherein at least one of said first and second magnetic armatures is moveable with respect to said amagnetic structure.

4. The selection device for a weaving system of claim 3 wherein said at least one of said first and second magnetic armatures is pivoted about said shaft and said amagnetic structure is independently articulated about said shaft.

5. The selection device for a weaving system of claim 4 wherein said at least one of said first and second magnetic armatures which is moveable is provided with a heel element adapted to transmit to said amagnetic structure a pivoting movement about said shaft.

6. The selection device for a weaving system of claim 4 wherein said amagnetic structure includes a bar adapted to transmit to said at least one of said first and second magnetic armatures which is moveable a pivoting movement about said shaft.

7. The selection device for a weaving system of claim 1 wherein each of the at least two hooks includes an opening therein, said free end of said at least one lever being selectively positioned within said openings in said at least two hooks.

8. The selection device for a weaving system of claim 7 wherein said free end of said at least one lever is adapted to be displaced by movement of one of the at least two hooks as said one of said at least two hooks is moved by the knife to a top dead center position.

9. In a weaving system for a Jacquard loom which includes at least two hooks which are selectively moveable with a reciprocating knife and each hook being connected to a funicular element which displaces a pulley for controlling the position of a heddle of a Jacquard harness, the improvement comprising; a three position selection device including two superposed electro magnets each adapted to be selectively activated, at least one lever having one end articulated about a shaft and a free end adapted to selectively engage the at least two hooks, said at least one lever including a first magnetic armature for selectively cooperating with a first of said electromagnets and a second magnetic armature for cooperating with a second of said electro magnets whereby the selective activation of said two electromagnets generates three different positions of said at least one lever relative to the at least two hooks by relative displacement of the first and second magnetic armatures relative to said first and second electromagnets.

10. In a weaving loom including a weaving system incorporating a selection device wherein the weaving system includes at least two hooks which are selectively moveable with a reciprocating knife with each hook being connected to a funicular element which displaces a pulley for controlling the position of a heddle of a harness, the improvement comprising; a three position selection device including two superposed electromagnets each adapted to be selectively activated, at least one lever having one end articulated about a shaft and a free end adapted to selectively engage the two hooks, said at least one lever including a first magnetic armature for selectively cooperating with a first of said electromagnets and a second magnetic armature for cooperating with a second of said electromagnets whereby the selective activation of said two electromagnets generates three different positions of said at least one lever relative to the at least two hooks by relative displacement of the first and second magnetic armatures relative to said first and second electromagnets.

* * * * *